US005690423A

United States Patent [19]

Hentz et al.

[11] Patent Number: 5,690,423

[45] Date of Patent: Nov. 25, 1997

[54] WIRE FRAME PAN ASSEMBLY FOR MOUNTING RECESSED LIGHTING IN CEILINGS AND THE LIKE

[75] Inventors: Joseph A. Hentz, Crawfordsville; Richard F. Ashcraft, Greenwood, both of Ind.

[73] Assignee: NSI Enterprises, Inc., Atlanta, Ga.

[21] Appl. No.: 610,431

[22] Filed: Mar. 4, 1996

[51] Int. Cl.[6] ..... F21S 1/02

[52] U.S. Cl. ..... 362/365; 362/366; 362/368; 248/302; 248/343

[58] Field of Search ..... 362/147, 288, 362/364, 365, 368, 366, 396; 248/343, 906, 302

[56] References Cited

U.S. PATENT DOCUMENTS

| | | | |
|---|---|---|---|
| 2,689,909 | 9/1954 | Dazley | 248/302 |
| 3,872,296 | 3/1975 | Cohen et al. | 248/343 |
| 3,912,865 | 10/1975 | Seebinger | 248/343 |
| 4,327,403 | 4/1982 | Capostagno et al. | 362/147 |
| 4,336,575 | 6/1982 | Gilman | 362/147 |
| 4,491,901 | 1/1985 | Sigety, Jr. | 362/368 |
| 4,972,339 | 11/1990 | Gabrius | 362/365 |
| 5,029,794 | 7/1991 | Wolfe | 362/365 |
| 5,505,419 | 4/1996 | Gabrius | 248/343 |
| 5,575,558 | 11/1996 | Coushaine et al. | 362/217 |
| 5,597,234 | 1/1997 | Winkelhake | 362/364 |

*Primary Examiner*—Thomas M. Sember
*Attorney, Agent, or Firm*—Kenneth E. Darnell

[57] ABSTRACT

A pan assembly for mounting of recessed lighting fixtures in ceilings and the like such as between structural joists, the invention primarily comprises a pan frame formed of wire bent according to various embodiments of the invention into particular configurations capable of carrying standard cans or reflector housings, junction box structures and bar hangers inter alia for rough-in of downlighting fixtures. In a preferred embodiment of the invention, the wire pan mounts adjustable bar hangers at first ends of the hangers while a junction box integrally formed with rail holders and mounted by the pan acts to mount the hangers at opposite ends of the hangers.

47 Claims, 6 Drawing Sheets

WIRE FRAME PAN ASSEMBLY FOR MOUNTING RECESSED LIGHTING IN CEILINGS AND THE LIKE

DESCRIPTION OF THE PRIOR ART

1. Field of the Invention

The invention relates generally to mounting structure for recessed downlighting and the like and particularly to low-cost, compact pan assemblies formed of wire frame elements.

2. Background of the Invention

Ceiling-mounted lighting fixtures which can be recessed into the ceiling in both new construction and in retrofit situations have become useful in a variety of lighting situations due in part to the unobtrusive nature of the fixtures themselves and of the illumination provided by the fixtures. In new construction, recessed lighting fixtures, generally known by the general term "downlighting" are intended for mounting to a ceiling support structure and particularly for mounting between joists or mounting to a gridwork supporting a suspended ceiling installation. In the conventional mounting of downlight fixtures, a mounting frame is generally provided which is structurally secured to joists or to a gridwork above the ceiling itself, a junction box being carried by the mounting frame and being connected to a source of electrical power through conduit extending from the junction box to a connection with a lamp housing typically referred to as a "can". Such conventional structure may incorporate a reflector assembly within the can, it also being possible to utilize a reflector assembly as the lamp housing or can. On installation of the recessed lighting fixture such as between joists of a ceiling, the ceiling is formed through the use of plasterboard, plaster, ceiling tile or the like to hide the recessed lighting fixture. A ceiling opening surmounted by the can allows light from the fixture to be directed substantially downwardly into the environmental space which is to be lit. The fixture can also be mounted to the gridwork of a suspended ceiling. The several structural elements comprising the recessed lighting fixture, that is, the housing or can, the junction box and bar hangers, among other elements, are carried by a frame member generally referred to as a "pan". Pans conventional in the art are typically formed of heavy-gauge painted steel platforms which are typically rectangular or square and which mount bar hanger structure along oppositely spaced edges of the pan. Such pans are typically used with incandescent lamps but can be configured for use with fluorescent, metal halide and high intensity discharge sources to name a few of the more common types of lighting utilized in recessed lighting situations. In the case of fluorescent lighting, the pan must usually be capable of mounting a ballast element for operation of the fluorescent light source. Even though the art has previously recognized the need for a recessed lighting fixture of reduced weight and compact structure, it is still common in the art to utilize very heavy steel pan structures as the supporting platforms in downlighting fixture assemblies. Due to the size and weight of prior pan frame structures including those portions of a recessed lighting fixture mounted to-such structures, the cost of shipping lighting fixtures of this type is substantial due not only to the volume required for containment of a single fixture within a shipping box or the like but also the weight of the total assemblies, a major portion of the weight being due to the pan itself. A long felt need has therefore existed in the art for a replacement of the stamped sheet metal pan commonly employed as the primary mounting plantform of a recessed lighting fixture such as a conventional downlight. A need exists for a less expensive downlight assembly such as would obtain from a discontinuation of the use of stamped sheet metal pans. The total expense necessary to place a downlighting assembly at a job site for installation would also be reduced by the provision of a more compact downlighting assembly such as could occur by means of an improved mounting pan which would be more volumetrically efficient for shipping purposes.

The prior art includes a variety of "pan" structures which are capable of mounting a standard can or reflector housing as well as junction boxes and the like. As one example, U.S. Pat. No. 4,313,154 to Capostagno et al provides a pan formed of sheet metal which is stamped to bend opposite edge portions into a track mounting bar hanging structure. The flat sheet metal pan of Capostagno et al is provided with an aperture cut from the flat pan and above which a standard can is mounted. The pan of Capostagno et al further mounts a junction box and associated conduit which connects to lamping housed within the can mounted to the planar pan. Druffel, in U.S. Pat. No. 4,471,416, describes a recessed lighting fixture having a mounting frame which is substantially square in conformation and is formed of stamped sheet metal having an aperture disposed centrally therein and above which aperture is mounted a standard can mounting a lamp therewithin. The Druffel structure further mounts a junction box and appropriate electrical conduit. In U.S. Pat. No. 4,972,339 to Gabrius, a recessed lighting fixture is described as being held in place by a frame comprised of brackets and slidably connected bar hangers which allow adjustment in the mounting of recessed lighting fixtures between joists or the like. The pan of Gabrius is also a planar pan having an aperture formed therein with opposing sides having hanger rails mounted thereon to allow mounting of the recessed lighting fixture carried by the planar pan to be mounted in a standard fashion. The Gabrius pan is also seen to be stamped from planar sheet metal stock. Carson et al, in U.S. Pat. No. 5,057,979, describes a recessed lighting fixture with portions thereof being mounted in a single piece and formed of plastic, the structure being mountable to the side of a single joist.

Prior downlight assemblies are typically mounted through means of bar hanger structures having barbed recessed nailers which are nailed to rafters, floor joists or the like. The prior art has commonly utilized bar hangers which are adjustable in length in order to accommodate varying distances between joists and supporting structure of this nature. A recessed lighting fixture assembly of the prior art typically includes a pair of bar hanger elements with one each of the elements being carried along oppositely disposed sides of a conventional mounting pan. Each bar hanger assembly on each side of the pan is formed of a pair of hanger elements slidably connected to each other so that the overall length created by the bar hangers may be adjusted to accommodate the particular spacing between supporting members. The ends of the bar hanger elements are provided with the barbed nailers which essentially comprise supporting ears formed with integral fasteners which can be readily nailed to joists or the like to connect the lighting fixture assembly in place between joists or other support structure. In the prior art, bar hangers are typically mounted directly to the pans themselves such as by stamping of sheet metal channels along those edges of the pan which are to mount the bar hangers. The resulting structure is expensive due to the need to form the bar hanger mounting channels through stamping techniques with additional cost and complexity being brought about by the need to then mount the relatively slidable hanger elements together for relative sliding within the stamped channels so formed. The prior art has experienced a long felt need for an improved mounting of bar hanger assemblies to a recessed lighting fixture which is to be mounted in a ceiling or the like with a primary intent being the ability to maintain the bar hanger assemblies in place on the lighting fixture assembly once assembled in a factory situation. By maintaining the bar hanger assemblies in place on the lighting fixture, the hanger structure does not become separated from the remainder of the fixture assembly during shipping or during subsequent handling at a job site. The present invention further improves recessed lighting fixture assemblies by providing integral rail holding slots in a junction box mounted to a wire frame pan whereby the bar hanger assemblies are mounted for sliding movement at two locations of the lighting fixture assembly, a first location being the slots integrally formed in the junction box mounted by the wire frame pan with the second location being on the wire frame pan itself. The present invention must provide substantial improvement over pan assemblies of the prior art by providing inexpensive, compact and volumetrically efficient pan structures which are light in weight relative to prior art pan assemblies and which are capable of mounting the substantial weights of recessed lighting fixtures in suspended arrangements between joists or other supporting frame work without warping or deflection of the pan structure when assembled in place.

SUMMARY OF THE INVENTION

The present invention provides an improved recessed lighting fixture assembly wherein the primary improvement relates to a pan structure formed of a wire frame. The wire pan of the invention can be inexpensively and compactly configured while exhibiting extraordinary resistance to warping and deformation under loading even when mounted in a use environment involving the carriage of substantial weight such as the weight of a standard can or reflector housing, a junction box structure and associated bar hangers for mounting of the fixture to joists or other supporting structure. The wire pan of the invention is simply formed from a length of wire having an appropriate gauge, the wire being bent into a conformation capable of supporting a housing can, a junction box, electrical conductor-bearing conduit and bar hangers inter alia without diminution of function when compared to more expensive platform-like pans such as are common in the art. The ability to be formed compactly provides to the present wire can a volumetric efficiency which conserves shelf space in storage and which allows reduced shipping costs due not only to lower assembly weight but also to the reduction in space occasioned by the structure of the pan itself. The wire pan of the invention is preferably formed of a length of solid 0.148" diameter steel wire, the wire pan itself being capable of formation from more than one length of such wire as is desired. It should be noted, however, that material of varying section could be utilized in the formation of the present wire pan, such materials including tubular materials. As a further alternative, combinations of solid and tubular material could be employed with the result that certain sections of the structure would be hollow.

The wire pan of the invention mounts a dual-access junction box which can be provided either with hinged covers or with snap-on covers as desired. The junction box in a preferred embodiment of the invention is formed with structure capable of mounting bar hanger assemblies on either side thereof with resulting simplification of the recessed lighting fixture for which the present wire pan provides a primary mounting platform. The wire pan itself has portions thereof bent into a conformation allowing a bar hanger assembly to fit therethrough, the bar hanger assemblies being mounted for sliding movement by the wire pan and by the junction box so that the bar hanger assemblies may be extended to a desired length for mounting between joists or the like at an appropriate spacing occasioned by a particular mounting situation.

The wire form pan of the invention acts as a basic mounting platform for remaining elements of a recessed lighting fixture or the like, a pair of bar hanger assemblies mounted by the wire pan or by the wire pan and associated junction box acting to allow mounting between joists or to the gridwork of a suspended ceiling or the like. A pair of bar hanger elements form each bar hanger assembly and have at distal ends thereof barbed recessed nailer plates which are integral with the bar hanger elements, these nailing plates allowing convenient and rapid mounting to the joists or gridwork as aforesaid. The recessed lighting fixture or downlighting fixture having the present wire pan as mounting platform acts as a rough-in above a ceiling, the ceiling hiding the fixture except for the provision of an aperture allowing light from the fixture to illuminate an environmental space below the ceiling. The recessed lighting fixtures of the invention are readily installed in new construction and may also be installed from below in remodeling situations. The fixtures utilizing the wire pan of the invention are commonly used with incandescent or other types of lamping mounted within a metal can carried by the wire pan, the can typically being formed of aluminum or steel.

Accordingly, it is the primary object of the invention to provide an inexpensive and lightweight mounting pan for carrying a standard can or reflector housing of a recessed lighting fixture such as a downlight fixture as well as a junction box structure, bar hanger assemblies and the like for mounting above a ceiling such as between joists or to gridwork suspending a ceiling, the wire pan of the invention being capable of improved function such as resistance to warping and deformation in use even though formed of less material than prior pan assemblies.

It is another object of the invention to provide a recessed lighting fixture improved by a wire pan formed of at least one length of solid wire or tubular stock which is bent into a desired configuration for mounting of a standard can or reflector housing as well as a junction box structure and bar hangers necessary for mounting of the recessed lighting fixture above a ceiling of an environmental space which is to be lit.

It is yet another object of the invention to provide an inexpensive and lightweight wire pan which when assembled in a factory situation with standard cans or reflector housings, junction box structures, bar hangers and the like requires a reduced volume relative to prior art fixture assemblies, thereby allowing a reduction in shipping costs and improved utilization of shelf space due to the volumetric efficiency of the recessed lighting fixture brought about by incorporation into the fixture of the wire pan of the invention.

Further objects and advantages of the invention will become more readily apparent in light of the following detailed description of the preferred embodiments.

DESCRIPTION OF THE PREFERRED EMBODIMENTS

Figure 5:
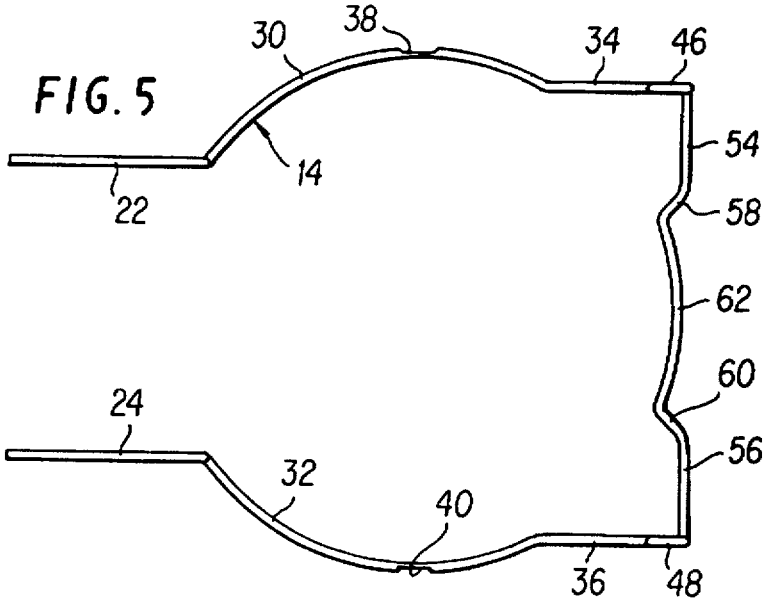
FIG. 5 is a plan view of the preferred wire frame pan of the invention.
Figure 7:
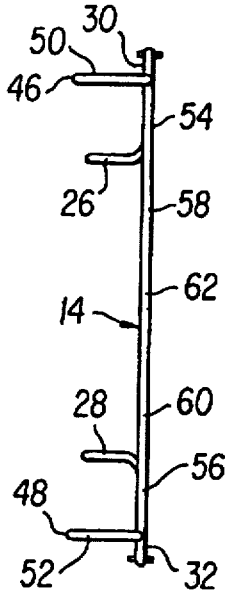
FIG. 7 is a front elevational view of the wire frame pan of FIG. 5.
Figure 6:
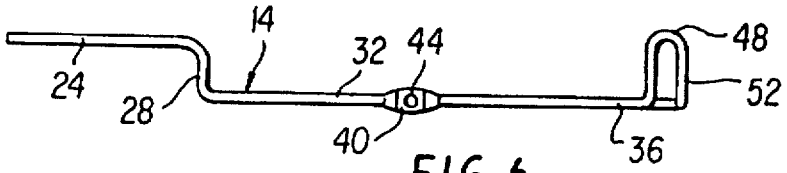
FIG. 6 is a side elevational view of the wire frame pan of FIG. 5.

Referring now to the drawings and particularly to FIGS. 1 through 4, a recessed lighting fixture is seen generally at 10 to comprise a wire frame pan 12 configured according to a first embodiment of the invention. The wire frame pan 12 is comprised of a wire frame 14 preferably formed of at least one length of #9 gauge galvanized steel wire (0.148" diameter) and which is bent to the shape also seen in FIGS. 5 through 7 as will be described hereinafter. The wire frame pan 12 functions in a manner similar to any of a variety of prior art pan structures to mount junction box 16 and can 20 for "rough-in" above a ceiling (not shown) to produce a downlighting affect in the environmental space below the ceiling. A standard conduit 17 extends from the junction box 16 to the can 20 to allow access of insulated wiring (not shown) into the interior of the can 20 to provide power to a lamp (not shown) mounted within the interior of the can 20. The connection of the electrical power to lamping within the can 20 through the junction box 17 is conventional and need not be described in detail herein.

The wire frame pan 12 is seen to be formable by simple bending processes from a single length of #9 gauge galvanized steel wire. While wire of different diameter can be utilized, the advantages of the invention are best realized through the use of wire having a gauge of 9 to 11, that is, a diameter of between 0.148" and 0.188". As will be discussed in greater detail hereinafter, the material used to form the frame 14 can have other cross-sectional shapes and can be formed of various materials. It is to be understood that the wire frame pan 12 could be formed from more than one length of wire and welded together, such as at certain discontinuities such as the location of "flats" as will be seen hereinafter. However, the wire frame pan 12 is more conveniently formed of a single length of wire such that the pan 12 can be formed by simple bending processes.

Considering now the actual structure of the preferred embodiment of the wire frame pan 12 as shown in FIGS. 1 through 7, it is to be seen that free end sections 22 and 24 of the frame 14 connect to the junction box as will be further described hereinafter. The free end sections 22 and 24 are each adjacent to respective downwardly bent sections 26 and 28 which essentially bend downwardly out of the plane of the free end sections 22 and 24 at substantially 90° angles therefrom. The bent sections 26 and 28 are then bent outwardly thereby forming arcuate central sections 30 and 32 respectively, the respective sections 30 and 32 lying in a plane essentially parallel with the plane in which the free end sections 22 and 24 lie. The arcuate central sections 30 and 32 then bend in plane to respectively form forward sections 34 and 36 which essentially lie within the same plane as the sections 30 and 32 and which extend substantially in the same direction as do the free end sections 22 and 24. Flats 38 and 40 are respectively stamped one each medially of the length of each of the central sections 30 and 32 to form flat 38 in the central section 30 and flat 40 in the central section 32. The flats 38 and 40 are respectively provided with apertures 42 and 44, the apertures 42 and 43 respectively receiving screws 39 to connect the wire frame 14 to the can 20 on each side of the frame 14 and from within the interior of the can 20 as will be described hereinafter. Sections 46 and 48 formed as upwardly extending, inverted U-shapes respectively terminate the forward sections 34 and 36. The U-shaped sections 46 and 48 are respectively formed of legs 49, 50 and 43, 52, the sections 46 and 48 mounting the hanger bar assembly 18 as will be described hereinafter within respective U-shaped channels 51 and 53 defined by said U-shaped sections 46 and 48. The sections 46 and 48 respectively terminate with side sections 54 and 56 which extend substantially perpendicularly to the forward sections 34 and 36 and toward each other. The side sections 54 and 56 each bend arcuately at inward ends thereof to form sections 58 and 60 which then terminate in forward arcuate section 62, the sections 54, 56, 58, 60 and 62 essentially lying in the same plane and also being co-planar with the sections 34, 36 and 30, 32. A flat (not shown) may be conveniently formed centrally of the arcuate section 62 and have an aperture (not shown) formed therein to receive a screw (not shown) in the manner of the flats 38, 40; apertures 42, 44 and screws 39 in order to provide three points of connection of the frame 14 to the can 12. In such a situation, a slot such as those slots described hereinafter for mounting of the can 20 would necessarily be formed in the can in juxtaposition to the location of the arcuate section 62 at which a flat could be formed. The contours of the arcuate central sections 30, 32 and the forward arcuate section 62 are of a shape and size to fit against portions of the outer walls of the can 20 thereby facilitating mounting of the can 20 to the frame 14 due to the tendency of the spring-like frame 14 to "grip" the can when the frame 14 is essentially provided with an inward bias of the free end sections 22 and 24 to cause the frame 14 to exhibit a "spring constant."

Figure 1:
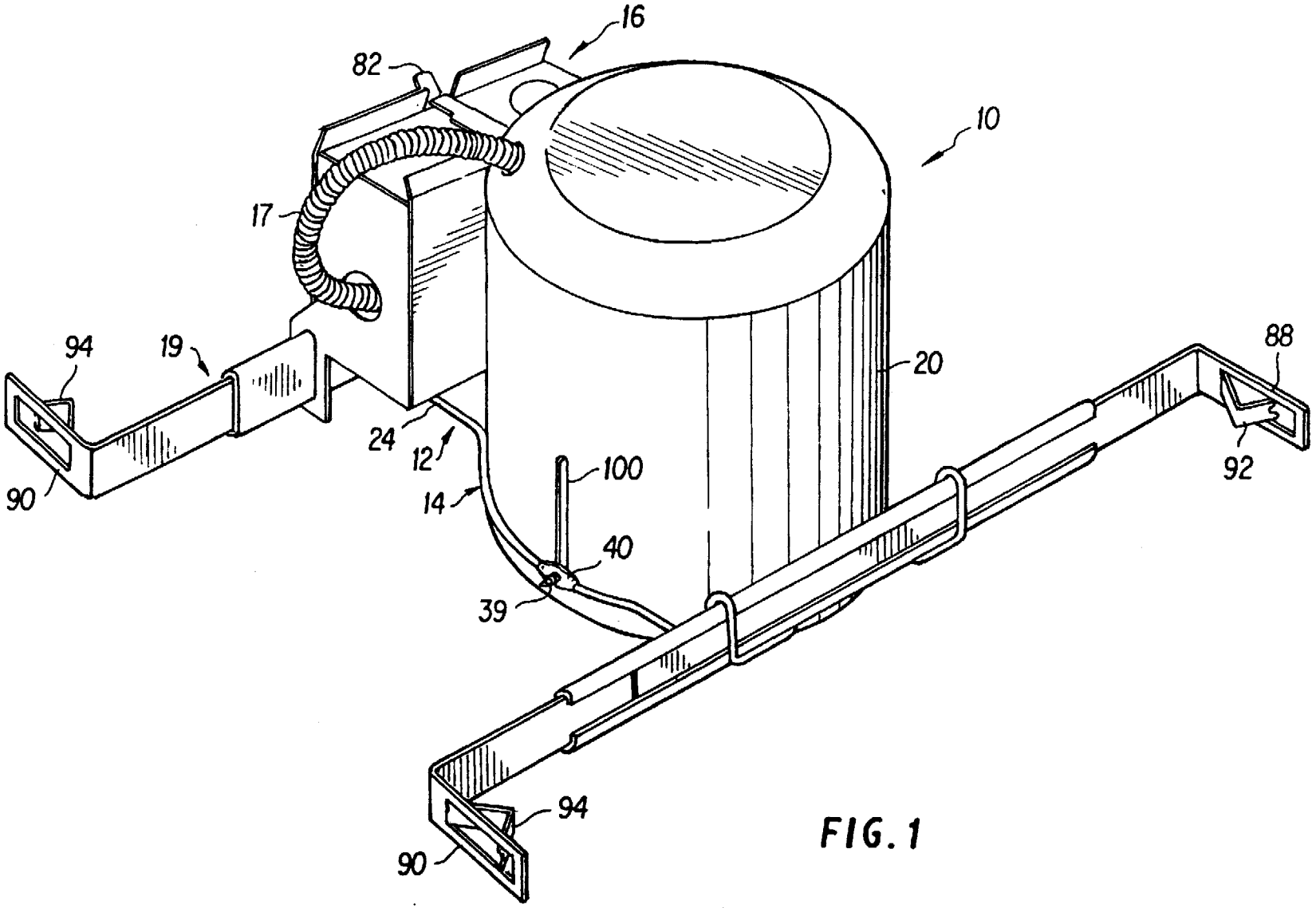
FIG. 1 is a perspective view of a downlighting fixture having a wire frame pan configured according to the invention.
Figure 3:
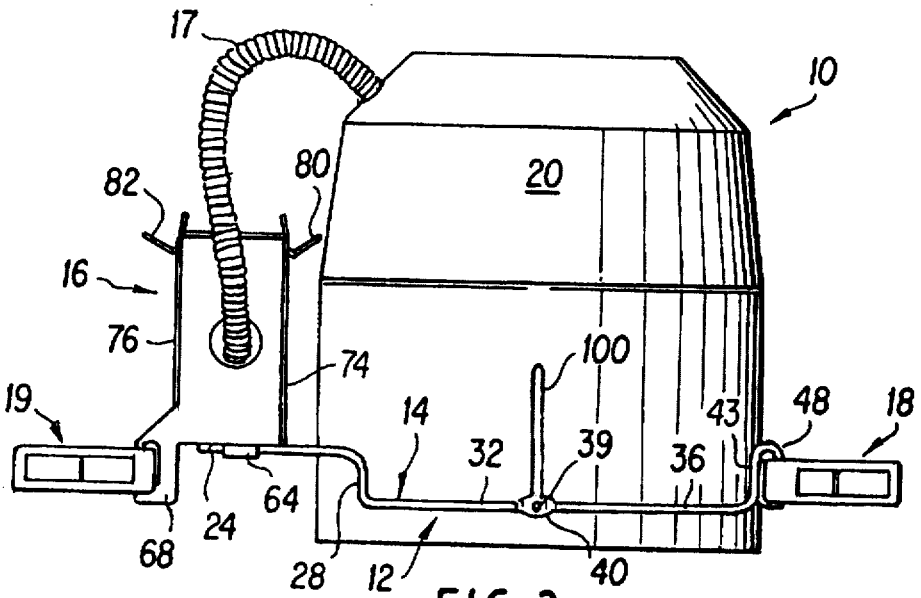
FIG. 3 is a side elevational view of the lighting fixture of FIG. 1.

The can 20 is seen best in FIGS. 1 and 3 to be provided with elongated slots 100 formed on each side thereof, one of the slots not being visible due to location on the opposite side of the can 20 as seen in FIG. 3 in particular. The slots 100 are formed in the can 20 in diametrically opposite relation to each other. These slots 100 respectively align with the apertures 42 and 44 formed in the flats 38 and 40 of the wire frame 14. As mentioned previously, screws such as the screws 39 are capable of being received one each through each of the slots 100 and then through the respective apertures 42, 44 to allow positive connection of the can 20 to the wire frame 14. Further, the elongation of the slots 100 in a direction parallel to the longitudinal axis of the can 20 allows adjustment of the can 20 relative to the pan 12 such that the can 20 can be caused to extend within a range defined by the lengths of the slots 100 so that the lower opening of the can 20 through which light exits can be adjusted downwardly from the pan 12. While the screws 39 are desirably used, the wire pan capable of holding the can in place without said screws 39 due to the frictional coupling of the spring-like frame 14 to the can 20 inter alia.

Figure 4:
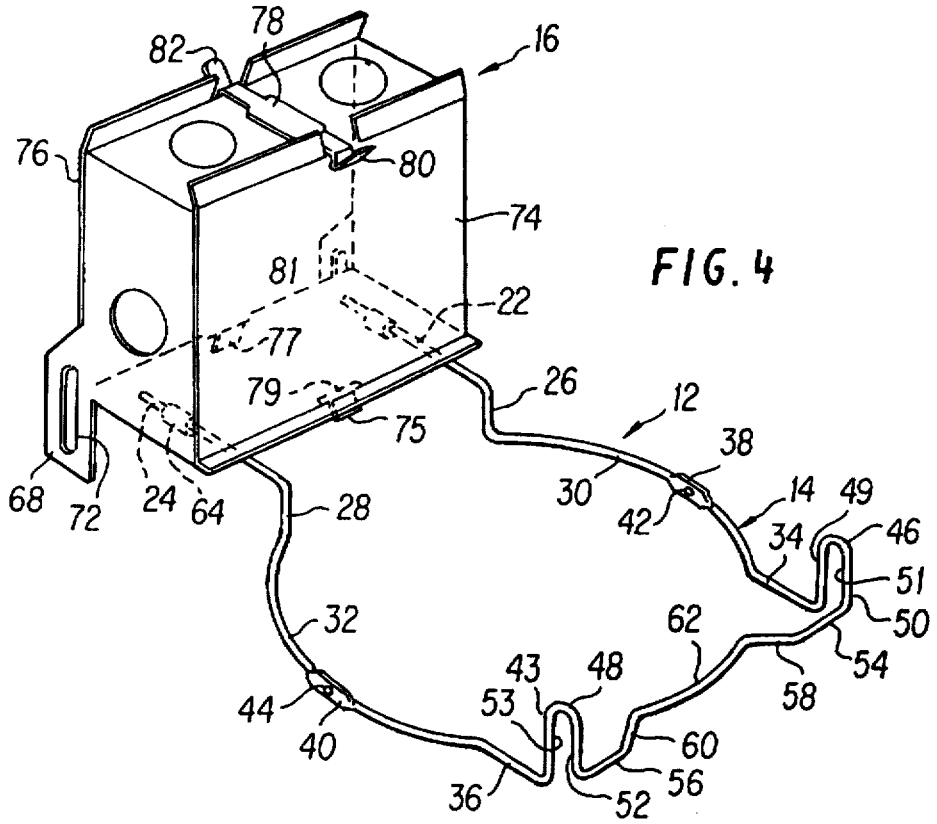
FIG. 4 is a perspective view of a preferred wire frame pan configured according to the invention and mounting a J-box, the J-box being configured to mount bar hangers.

As is best seen in FIGS. 3 and 4, the junction box 16 is provided with receiving tabs 64 on either side laterally thereof and at lower portions of the box 16. The receiving tabs 64 can be bent around the respective free end sections 22 and 24 of the wire frame 14 to mount the junction box 16 to the pan 12. The junction box 16 is further formed with mounting plates 66 and 68 which extend from either end of the junction box 16 on the side thereof disposed outwardly of the pan 12, the mounting plates 66 and 68 being respectively formed with slots 70 and 72 which receive the hanger bar assembly 19 therethrough for mounting of the hanger bar assembly 19 to the fixture 10. The junction box 16 is thus provided integrally with structure suitable for mounting of the hanger bar assembly 19.

In preferred embodiments, the main body of the junction box 16 can be formed of a flat, stamped piece of metal which is then bent to assemble the junction box 16 with the mounting plates 66 and 68 being integral therewith. As is best seen in FIGS. 1, 3 and 4, the junction box 16 is provided with removable covers 74 and 76 to allow access from either side of the junction box 16, the covers 74 and 76 being snap-fit in place by means of a leaf spring 78 formed of a flat piece of metal which is recurved at each end to form snap elements 80 and 82, each of the snap elements 80 and 82 respectively biasing against upper portions of the covers 74 and 76 to hold said covers in place on the junction box 16. Each of the covers 74 and 76 are provided with tabs 75 and 77 which respectively fit into slots 79 and 81 formed in lower portions of the junction box 16 to facilitate mounting of the covers 74 and 76 in place on the junction box 16. The remaining structure and function of the junction box 16, including the various knockouts and the like are conventional in the art.

The hanger bar assembly 18 located at the opposite end of the fixture 10 from the hanger bar assembly 19 is held within the U-shaped channels defined by the U-shaped sections 46 and 48 of the wire frame 14. A screw (not shown) is preferably used in association with an aperture (not shown) formed in the frame 14 for locking the hanger bar assembly 18 to the wire frame 14. Accordingly, the hanger bar assembly 18 is mounted to the recessed lighting fixture 10 through direct connection to the wire frame 14 and thus the pan 12. The hanger bar assembly 19 is mounted by the junction box 16 by means of the mounting plates 66 and 68 which may be integrally formed with the junction box 16.

Figure 2:
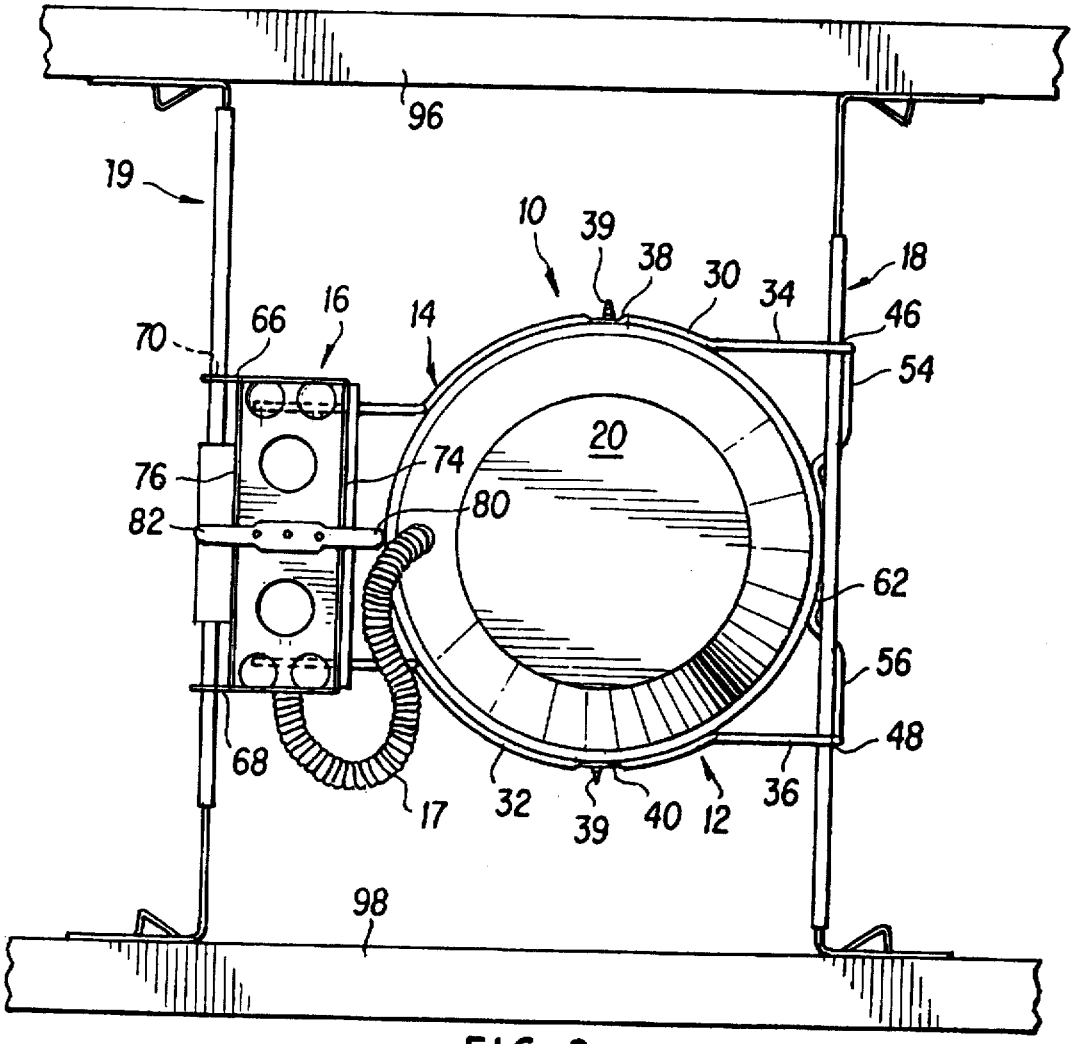
FIG. 2 is a plan view of a recessed downlighting fixture configured according to the invention and installed between adjacent joists, the fixture being thus seen in a "rough-in" situation.

The structure and function of the hanger bar assemblies 18 and 19 are essentially identical. For this reason, a description of the hanger bar assembly 18 will suffice for a description of both. As is best seen in FIGS. 20 through 23, the hanger bar assembly 18 is formed of a housing element 84 and a slide element 86, the housing element 84 having a guideway 85 formed thereon by the bending over of opposite lateral edges of said element 84 to form the guideway 85 which receives the slide element 86 thereinto for sliding movement. Each of the elements 84 and 86 are provided with nailing plates 88 and 90 which are respectively bent at angles of 90° relative to the longitudinal axes of the elements 84 and 86. Barbs 92 and 94 can conveniently be stamped from the planar body portions of the nailing plates 88 and 90 respectively to facilitate rapid mounting to joists 96 and 98 as seen in FIG. 2. The mounting of a recessed lighting fixture such as the fixture 10 to the joists 96 and 98 is essentially conventional. The hanger bar assemblies 18 and 19 can be adjusted lengthwise by virtue of the ability of the elements 84 and 86 to slide relative to each other. Stiffening ribs 97 and 99 strengthen the element 86. Structure such as conventional dimples (not shown) and the like can be formed on the elements 84 and 86 to keep the elements 84 and 86 from sliding apart. The holes 103 formed in the element 84 allow over-riding of such dimple structure on the element 86 if used. When using suspended ceilings and the like, a T-hanger 107 allows mounting to T-bar structures (not shown) of such suspended ceilings. A distance scale at 109 allows estimation of the degree of elongation of the assembly 18.

Prior to a discussion of alternate embodiments of the wire frame 14, it is to be understood that the material forming the frames such as the frame 14 can be chosen from a variety of materials having varying cross-sectional shapes. Materials such as steel and other metals as well as polymeric materials can be employed in the manufacture of the frames. When using polymeric materials, the frame would usually be molded rather than bent as would be the case with metals. Cross-sectional shapes including square, rectangular, polygonal, etc., as well as round, can be employed with hollow stock being also useful in a similar range of cross-sectional shapes. Rectangular cross-sectional shapes resulting in strap-like stock is also envisioned according to the invention. Rigidity of the frame is desirable in order to support the several portions of the fixture 10 which must be mounted by the pans of the invention such as the pan 12 described above. Materials having cross-sectional shapes such as J-shapes, L-shapes, U-shapes, C-shapes, etc., as well as solid or tubular circular, solid or tubular oval, and similar cross-sectional shapes can be employed. The various shapes and materials are generically included in the definition of the term "wire" as used herein.

Figure 8:
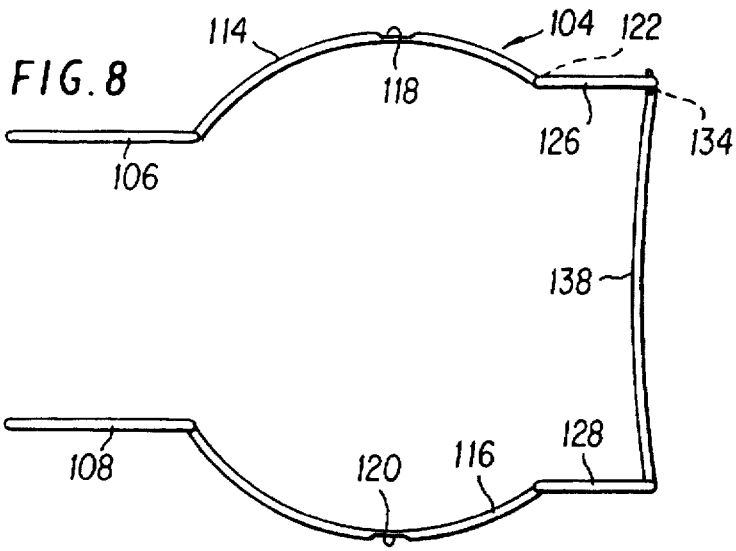
FIG. 8 is a plan view of another embodiment of the wire frame pan of the invention.
Figure 10:
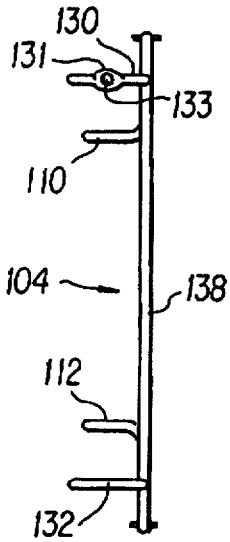
FIG. 10 is a front elevational view of the wire frame pan of FIG. 8.
Figure 9:
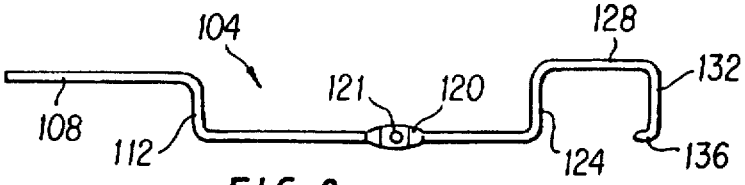
FIG. 9 is a side elevational view of the wire frame pan of FIG. 8.

Referring now to FIGS. 8 through 10, a wire frame 104 is seen to comprise free end sections 106 and 108 which connect to a junction box (not shown) as has been previously described relative to the wire frame 14. The free end sections 106 and 108 are each adjacent to respective downwardly bent sections 110 and 112 which essentially bend downwardly out of plane of the free end sections 106 and 108 at 90° angles therefrom. The bent sections 110 and 112 respectively bend outwardly to form arcuate central sections 114 and 116 respectively, the respective sections 114 and 116 lying in a plane essentially parallel with the plane in which the free end sections 106 and 108 lie. The arcuate central sections 114 and 116 then bend at 90° angles to respectively form interior sections 122 and 124, the sections 122 and 124 respectively bending at 90° angles to form upper sections 126 and 128. The sections 126 and 128 respectively bend at 90° angles to form forward vertical sections 130 and 132 which each bend inwardly to form arcuate section 138. Flats 118 and 120 respectively formed in the arcuate central sections 114 and 116 are provided with apertures such as the aperture 121 formed in the flat 120 to allow mounting of a can as has been described hereinabove relative to mounting of the can 20 to the wire frame 14. A flat 131 having an aperture 133 formed therein can be employed to receive a screw (not shown) for mounting of a hanger bar assembly (not shown) to the wire frame 104, a hanger bar assembly so mounted to the frame 104 being received immediately rearwardly of the sections 130 and 132 and being carried by said sections.

Figure 11:
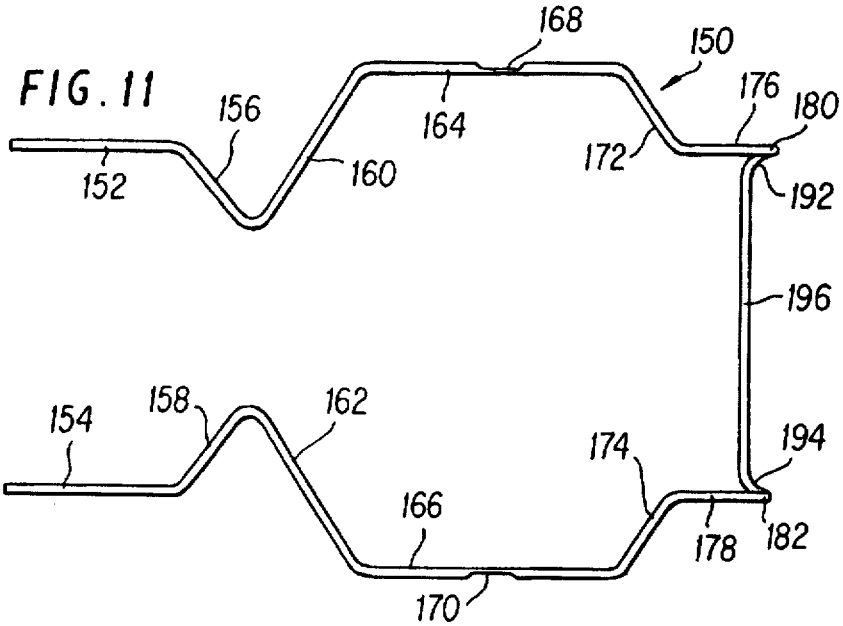
FIG. 11 is a plan view of yet another wire frame pan configured according to the invention.
Figure 13:
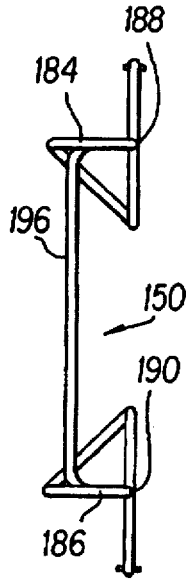
FIG. 13 is a front elevational view of the wire frame pan of FIG. 11.
Figure 12:
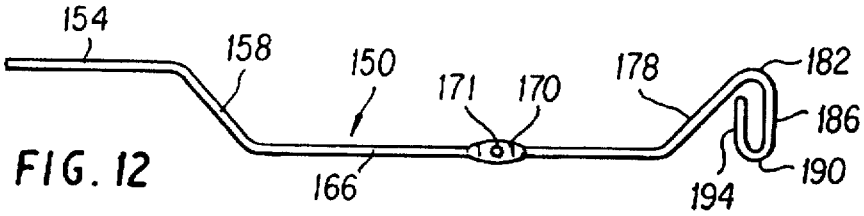
FIG. 12 is a side elevational view of the wire frame pan of FIG. 11.

Referring now to FIGS. 11 through 13, a wire frame 150 is seen to be formed of free end sections 152 and 154 which correspond in structure and function to the free end sections 22 and 24 of the wire frame 14 described above. The free end sections 152 and 154 respectively bend downwardly and inwardly to form sections 156 and 158 which then respectively bend outwardly to form sections 160 and 162. The sections 160 and 162 respectively bend in plane to form sections 164 and 166. The sections 164 and 166 are formed with flats 168 and 170 respectively formed therein, the flats having apertures such as aperture 171 formed in the flat 170 for mounting of a can (not shown) to the frame 150 in the manner of the mounting of the can 20 to the wire frame 14 as described above. The sections 164 and 166 bend inwardly in plane to form sections 172 and 174 which then bend upwardly at their respective ends to form sections 176 and 178. Each of the sections 176 and 178 curve downwardly at 180 and 182 respectively to form forward sections 184 and 186 which then recurve at 188 and 190 to form sections 192 and 194 which are respectively parallel to the sections 184 and 186. The sections 192 and 194 then bend inwardly substantially at 90° angles to form terminating section 196. As will be appreciated from the teachings provided hereinabove relative to the frame 14, a hanger bar assembly (not shown) is received between the sections 184,186 and 192, 194 which substantially act to form inverted, U-shaped channels through which such a hanger bar assembly can be received and mounted to the frame 150.

Figure 14:
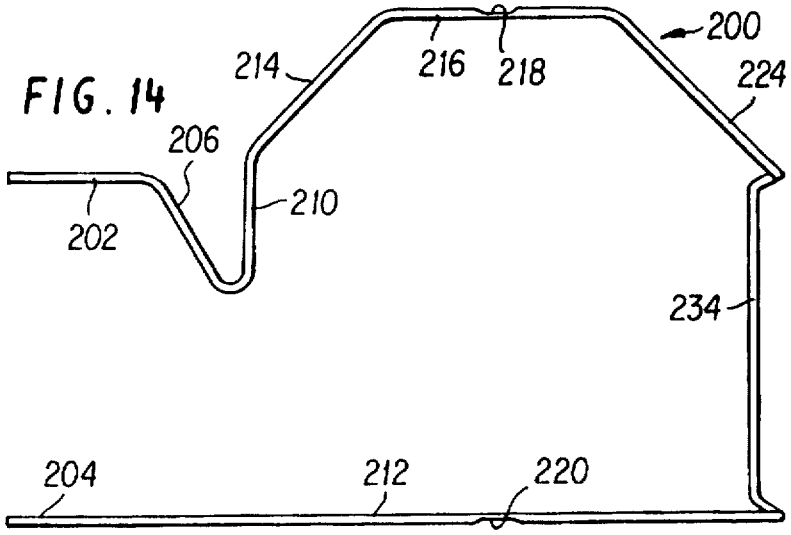
FIG. 14 is a plan view of a further embodiment of the wire frame pan configured according to the invention.
Figure 16:
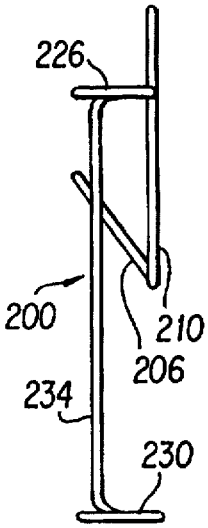
FIG. 16 is a front elevational view of the wire frame pan of FIG. 14.
Figure 15:
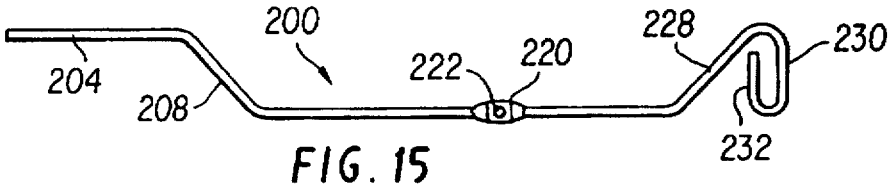
FIG. 15 is a side elevational view of the wire frame pan of FIG. 14.

Referring now to FIGS. 14 through 16, a further embodiment of the invention can be seen to comprise a wire frame 200 having free end sections 202 and 204. The free end section 202 bends downwardly and inwardly to form section 206 while the free end section 204 bends downwardly to form the section 208. The section 206 recurves laterally to form section 210, the section 210 then curving outwardly to form the section 214. The section 214 bends in a direction essentially parallel to the axis of the section 202 to form the section 216 within which a flat 218 is formed. The section 208 bends in a direction parallel to the axis of the section 204 to form an elongated section 212 within which a flat 220 is formed. Apertures formed in the flats 218, 220, such as the aperture 222 formed in the flat 220 are used in association with screws (not shown) to mount a can (not shown) to the wire frame 200 in a manner similar to that described relative to the mounting of the can 20 to the frame 14 supra. The section 216 bends upwardly out of plane and inwardly to form section 224, the section 212 bending upwardly out of plane to form section 228. The section 224 bends downwardly essentially at a 90° angle to form section 226 while the section 228 bends at an obtuse angle to form section 230, the section 230 then recurving at a 180° angle to form section 232, the sections 230 and 232 being parallel to each other. The sections 226 and 232 then bend inwardly to form terminating section 234. A hanger bar assembly (not shown) can be mounted in the inverted, U-shaped channel formed by the sections 230 and 232 and essentially rearwardly of the section 226 to mount a bar hanger assembly to the frame 200 in a manner similar to the mounting of a bar hanger assembly to the wire frame 14 described relative to FIGS. 1 through 7.

Figure 17:
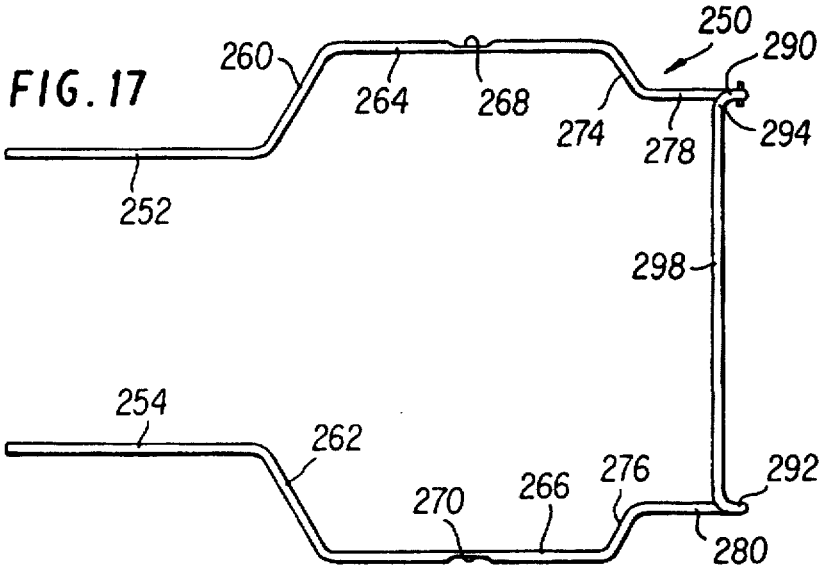
FIG. 17 is a plan view of a still further embodiment of the wire frame pan configured according to the invention.
Figure 19:
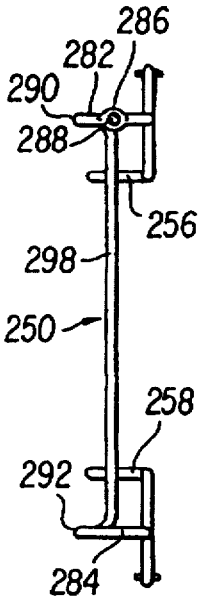
FIG. 19 is a front elevational view of the wire frame pan of FIG. 17.
Figure 18:
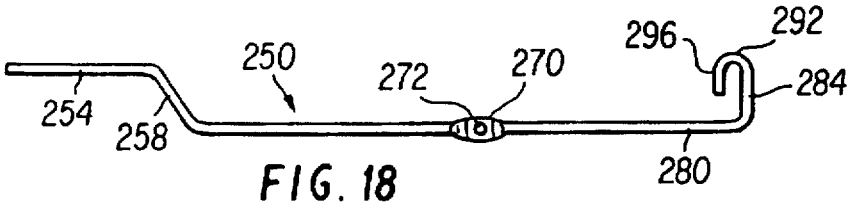
FIG. 18 is a side elevational view of the wire frame pan of FIG. 17.
Figure 20:
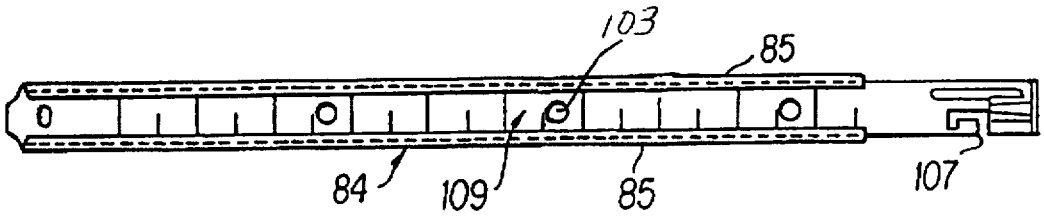
FIG. 20 is a side elevational view of the guideway element of a hanger bar assembly utilized with the wire frame pan of the invention.
Figure 21:
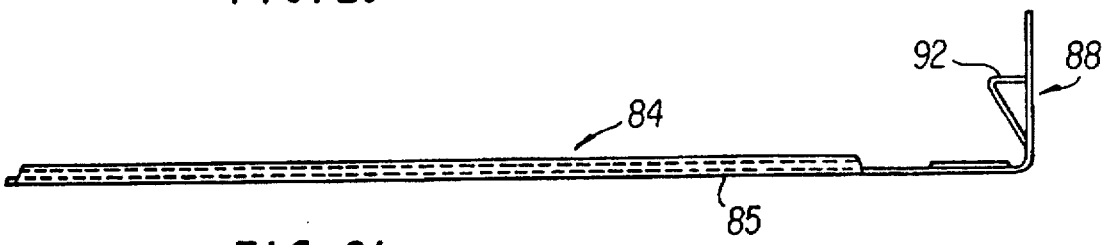
FIG. 21 is a plan view of the housing element of the hanger bar assembly of FIG. 20.
Figure 22:
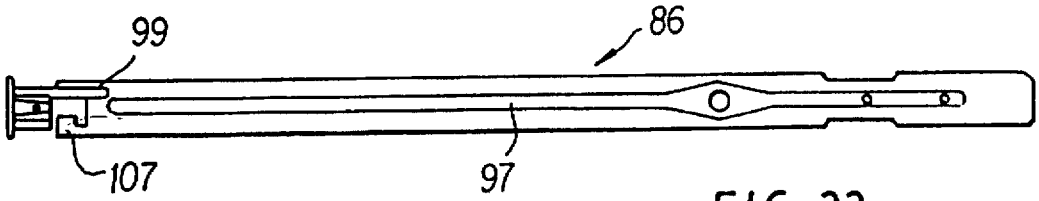
FIG. 22 is a side elevational view of a slide element of a hanger bar assembly utilized with the wire frame pan of the invention; and, FIG. 23 is a side elevational view of the slide element of the hanger bar assembly of FIG. 22.
Figure 23:
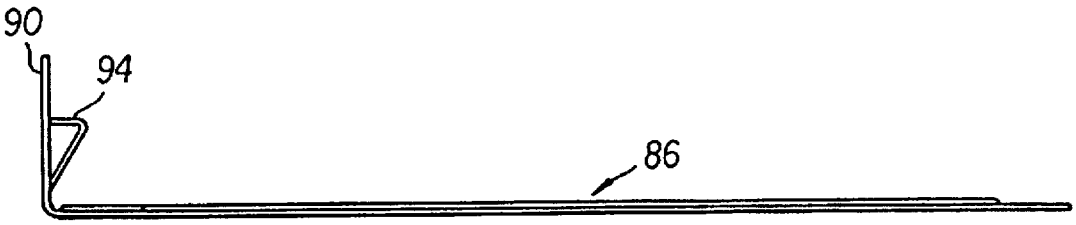

Referring now to FIGS. 17 through 19, a wire frame 250 comprising yet another embodiment of the invention is seen to be formed of free end sections 252 and 254 having essentially the same structure and function of the free end sections 22 and 24 of the wire frame 14. The free end sections 252 and 254 are each adjacent to respective downwardly bent sections 260 and 262, the sections 260 and 262 bending downwardly and outwardly before bending to form central sections 264 and 266, the plane in which the sections 264 and 266 lie being parallel to the plane within which the free end sections 252 and 254 lie. The central sections 264 and 266 are respectively formed with flats 268 and 270 having apertures formed therein such as the aperture 272 formed in the flat 270. Through use of the apertures formed in the flats 268 and 270 in association with screws (not shown), a can (not shown) can be mounted to the frame 250 in a manner similar to the mounting of the can 20 to the wire frame 14 as described relative to FIGS. 1 through 7. The sections 264 and 266 bend inwardly in plane to form sections 274 and 276, the sections 274 and 276 then bending in plane to form sections 278 and 280 which extend in substantially the same direction as do the central sections 264 and 266. The sections 278 and 280 respectively bend upwardly at 90° angles to form forward sections 282 and 284, said sections 282 and 284 respectively bending at 180° angles at 290 and 292 to form sections 294 and 296. The sections 294 and 296 are parallel respectively to the sections 282 and 284 and form inverted, U-shaped channels within which a hanger bar assembly can be received. The sections 294 and 296 then bend inwardly to form terminating section 298. A flat 286 formed in the section 282 is provided with an aperture 288 which can receive a screw (not shown) to lock a hanger bar assembly (not shown) to the wire frame 250.

While five different wire frame structures have been described herein as being useful according to the invention for forming wire frame pans according to the invention, it is to be understood that other structural conformations could readily be devised to provide the function provided by the wire frames 14, 104, 150, 200 and 250 which are explicitly described and shown herein. Similarly, other structure herein explicitly described can be configured other than as expressly shown and described herein. Accordingly, it can be readily understood in view of the particular embodiments of the invention which are expressly described hereinabove that the invention can be formed in a wide variety of configurations without departing from the intended scope of the invention, the scope of the invention being defined by the recitations of the appended claims.

What is claimed is:

1. In a recessed lighting fixture assembly having a pan supporting a lamp housing, a junction box, electrical connections between the junction box and the housing and bar hanger assemblies for mounting of the fixture assembly to portions of a building structure, the improvement comprising a pan frame formed of a length of wire bent to a configuration capable of supporting the housing.

2. In the improvement of claim 1 wherein the pan frame comprises free ends connected to the junction box for mounting said junction box to the pan frame.

3. In the improvement of claim 1 wherein central portions of the pan frame are bent within a plane into a shape dimensioned to receive the housing.

4. In the improvement of claim 3 and further comprising means carried by the pan frame for attachment to the housing to hold the housing to the pan frame.

5. In the improvement of claim 4 wherein the housing is formed with at least one longitudinally disposed slot and the means for attachment of the housing to the pan frame comprises at least one flat formed in the pan frame and having an aperture formed in the flat, the attachment means further comprising a connector received through the aperture formed in the flat and connecting to the slot in the housing to allow the housing to be positionally adjusted relative to the pan frame.

6. In the improvement of claim 1 wherein medial portions of the pan frame are formed into spaced U-shaped sections thereby forming an aligned guideway through which one of the bar hanger assemblies can be mounted.

7. In the improvement of claim 6 wherein the pan frame comprises free ends connected to the junction box for mounting said junction box to the pan frame, the junction box having integral mounting plates formed thereon, the plates each having a slot formed therein, the slots being aligned to receive one of the bar hanger assemblies therethrough to mount said bar hanger assembly to the fixture assembly.

8. In the improvement of claim 1 wherein the wire comprises a material having an open tubular cross-sectional shape.

9. In the improvement of claim 1 wherein the pan frame is formed of solid wire bent to a configuration capable of supporting the lamp housing, junction box, electrical connections and the bar assemblies.

10. A pan for mounting a lamp housing, a junction box, electrical connections between the junction box and the housing and bar hanger assemblies for mounting a fixture assembly thus resulting to portions of a building structure, the pan comprising a pan frame formed of a tubular material configured to support the lamp housing, junction box, electrical connections and the bar assemblies.

11. The pan of claim 10 wherein the tubular material is hollow.

12. The pan of claim 10 wherein the pan frame comprises free ends connected to the junction box for mounting said junction box to the pan frame.

13. The pan of claim 12 wherein the junction box has integral mounting plates formed thereon, the plates each having a slot formed therein, the slots being aligned to receive one of the bar hanger assemblies therethrough for mounting said bar hanger assembly to the fixture assembly.

14. The pan of claim 10 wherein central portions of the pan frame are bent within a plane into a shape dimensioned to receive the housing.

15. The pan of claim 14 and further comprising means carried by the pan frame for attachment to the housing to hold the housing to the pan frame.

16. The pan of claim 15 wherein the housing is formed with at least one longitudinally disposed slot and the attachment means comprise at least one flat formed in the pan frame and having an aperture formed therein, the attachment means further comprising a connector received through the aperture formed in the flat and connecting to the slot in the housing to allow the housing to be positionally adjusted relative to the pan frame.

17. The pan of claim 10 wherein medial portions of the pan frame are formed into spaced U-shaped sections thereby forming an aligned guideway through which one of the bar hanger assemblies can be mounted.

18. In a recessed lighting fixture assembly having a pan supporting a housing and a lamp operatively mounted within the housing, the fixture assembly further including a junction box and electrical connections between the junction box and the housing, the fixture assembly carrying structure capable of mounting said fixture assembly to portions of a building structure, the improvement comprising a pan frame formed of at least one length of wire to a configuration capable of directly mounting the housing and thus the fixture assembly.

19. The pan of claim 18 wherein at least portions of the pan frame are formed of solid wire.

20. The pan of claim 18 wherein at least portions of the wire comprise a tubular material.

21. The pan of claim 20 wherein at least portions of the tubular material are hollow.

22. The pan of claim 18 wherein at least portions of the wire are solid and are formed of a 0.148 inch diameter steel material.

23. The pan of claim 18 wherein the pan frame is formed of a polymeric material.

24. The pan of claim 18 wherein the pan frame comprises free ends connected to the junction box for mounting said junction box to the pan frame, the free ends being each respectively adjacent to downwardly bent sections which bend downwardly out of a plane in which the free ends lie, the bent sections each bending outwardly to form respective arcuate central portions which lie in a plane essentially parallel with the plane in which the free ends lie, the arcuate central sections each bending in plane to respectively form forward sections which respectively extend essentially in directions in which the free ends extends, the forward sections respectively terminating in upwardly extending, inverted U-shaped sections which respectively terminate in side sections which extend substantially perpendicularly to the forward sections and toward each other and bending arcuately at inward ends thereof and which terminate and respectively join in a forward arcuate section, the side sections, the arcuate inward ends of the side sections and the forward arcuate section essentially lying in a same plane and essentially being coplanar with the forward sections and with the central arcuate sections.

25. The pan of claim 24 wherein the arcuate contours of the central arcuate sections and of the forward arcuate section are of a shape and size to fit against outer wall portions of the lamp housing to grip the housing, the free ends of the pan frame having an inward bias to facilitate gripping of the housing by the pan frame.

26. The pan of claim 25 wherein the housing comprises a cylindrical can, the pan frame fitting to the contours of the can at an open, lower end of the can.

27. The pan of claim 24 wherein the pan frame further comprises means carried by the pan frame for attachment to the housing to hold the housing to the pan frame.

28. The pan of claim 27 wherein the housing is formed with at least one longitudinally disposed slot and the attachment means comprise at least one flat formed in the pan frame and an aperture formed in the flat, the attachment means further comprising a connector received through-the aperture formed in the flat and connecting to the slot in the housing to allow the housing to be positionally adjusted relative to the pan frame.

29. The pan of claim 28 wherein one each of the flats is formed substantially medially of each of the central arcuate sections.

30. The pan of claim 18 and further comprising means carried by the pan for mounting the pan to a supporting structure.

31. In the improvement of claim 18 wherein the fixture assembly further includes at least one bar hanger assembly carried by the pan frame for mounting the fixture assembly to the building structure.

32. A pan for mounting at least a lamp housing, a junction box and electrical connections between the junction box and the lamp housing, the pan comprising a pan frame formed of at least one length of wire formed to a configuration capable of supporting the housing, wherein the pan frame comprises free ends connected to the junction box for mounting said junction box to the pan frame, the free ends being each respectively adjacent to downwardly bent sections which bend downwardly out of the plane in which the free ends lie, the bent sections each bending outwardly to form respective arcuate central portions which lie in a plane essentially parallel with the plane in which the free ends lie, the arcuate central sections each bending in plane to respectively form forward sections which respectively extend essentially in directions in which the free ends extend, the forward sections respectively terminating in upwardly extending, inverted U-shaped sections which respectively terminate in side sections which extend substantially perpendicularly to the forward sections and toward each other and bending arcuately at inward ends thereof and which terminate and respectively join in a forward arcuate section, the side sections, the arcuate inward ends of the side sections and the forward arcuate section essentially lying in a plane and essentially being coplanar with the forward sections and with the central arcuate sections.

33. The pan of claim 32 wherein the arcuate contours of the central arcuate sections and of the forward arcuate section are of a shape and size to fit against outer wall portions of the lamp housing to grip the housing, the free ends of the pan frame having an inward bias to facilitate gripping of the housing by the pan frame.

34. The pan of claim 33 wherein the housing comprises a cylindrical can, the pan frame fitting to the contours of the can at an open, lower end of the can.

35. The pan of claim 32 wherein the pan frame further comprises means carried by the pan frame for attachment to the housing to hold the housing to the pan frame.

36. The pan frame of claim 35 wherein the housing is formed with at least one longitudinally disposed slot and the attachment means comprise at least one flat formed in the pan frame and an aperture formed in the flat, the attachment means further comprising a connector received through the aperture formed in the flat and connecting to the slot in the housing to allow the housing to be positionally adjusted relative to the pan frame.

37. The pan of claim 36 wherein one each of the flats is formed substantially medially of each of the central arcuate sections.

38. The pan of claim 32 wherein at least portions of the pan frame are formed of solid wire.

39. The pan frame of claim 32 wherein at least portions of the wire comprise a tubular material.

40. The pan of claim 39 wherein at least portions of the tubular material are hollow.

41. The pan of claim 32 wherein at least portions of the wire are solid and are formed of a 0.148" diameter steel material.

42. The pan of claim 32 wherein the pan frame is formed of a polymeric material.

43. In a recessed lighting fixture assembly having a pan supporting a recessed lighting fixture can and a lamp mounted within the can, the fixture assembly further including a junction box and electrical connections between the junction box and the can, the fixture assembly including structure mounting said fixture assembly to portions of a building structure, the improvement comprising a pan frame formed of at least one length of wire to a configuration capable of supporting the fixture assembly.

44. In the improvement of claim 43 wherein the wire comprises a material having an open tubular cross-sectional shape.

45. In the improvement of claim 43 wherein at least portions of the pan frame are formed of solid wire.

46. In the improvement of claim 43 wherein at least portions of the wire comprise a tubular material.

47. In the improvement of claim 43 wherein the pan supports a junction box and bar hanger assemblies for mounting of the fixture assembly to portions of a building structure.

* * * * *